US010395595B2

(12) United States Patent
Matsui et al.

(10) Patent No.: US 10,395,595 B2
(45) Date of Patent: Aug. 27, 2019

(54) DISPLAY DEVICE

(71) Applicant: JOLED INC., Tokyo (JP)

(72) Inventors: Masafumi Matsui, Tokyo (JP); Hitoshi Tsuge, Tokyo (JP); Kohei Ebisuno, Tokyo (JP)

(73) Assignee: JOLED INC., Tokyo (JP)

( * ) Notice: Subject to any disclaimer, the term of this patent is extended or adjusted under 35 U.S.C. 154(b) by 148 days.

(21) Appl. No.: 15/609,446

(22) Filed: May 31, 2017

(65) Prior Publication Data

US 2017/0352314 A1 Dec. 7, 2017

(30) Foreign Application Priority Data

Jun. 2, 2016 (JP) ..... 2016-111171

(51) Int. Cl.
*G09G 3/3258* (2016.01)
*G09G 3/3266* (2016.01)
*G09G 3/3291* (2016.01)

(52) U.S. Cl.
CPC ..... *G09G 3/3258* (2013.01); *G09G 3/3266* (2013.01); *G09G 3/3291* (2013.01); *G09G 2300/0426* (2013.01); *G09G 2320/0209* (2013.01); *G09G 2320/0233* (2013.01)

(58) Field of Classification Search
CPC .. G09G 3/3258; G09G 3/3266; G09G 3/3291; G09G 2300/0426; G09G 2320/0209; G09G 2320/0233
See application file for complete search history.

(56) References Cited

U.S. PATENT DOCUMENTS 5,495,265 A * 2/1996 Hartman ..... G09G 3/3648 345/100
2011/0285691 A1* 11/2011 Takasugi ..... G09G 3/3233 345/212
2013/0021320 A1* 1/2013 Yamashita ..... G09G 3/3618 345/214
2015/0221253 A1 8/2015 Yamamoto et al.

FOREIGN PATENT DOCUMENTS

JP 2009-080367 4/2009
JP 2010-008522 1/2010
JP 2010-266498 11/2010
JP 2011-215401 10/2011
JP 2014-048485 3/2014

* cited by examiner

*Primary Examiner* — Wing H Chow
(74) *Attorney, Agent, or Firm* — Greenblum & Bernstein, P.L.C.

(57) ABSTRACT

Pixel circuits each include a write transistor having a gate electrode connected to a write control line, one of a drain electrode and a source electrode connected to a data line for transmitting data voltage corresponding to luminance of the pixel circuit, and the other of the drain electrode and the source electrode connected to a gate electrode of a drive transistor. A compensation circuit includes a compensation transistor connected to a compensation signal line and the write control line. A compensation voltage generation circuit outputs compensation control voltage in accordance with a representative value of data voltage for the pixel circuits. A capacitance of the write control line caused by the compensation transistor and a capacitance of the write control line caused by the write transistors of the pixel circuits have mutually opposite voltage dependence with respect to the representative value of the data voltage for the pixel circuits.

3 Claims, 13 Drawing Sheets

DISPLAY DEVICE

CROSS REFERENCE TO RELATED APPLICATION

The present application is based on and claims priority of Japanese Patent Application No. 2016-111171 filed on Jun. 2, 2016. The entire disclosure of the above-identified application, including the specification, drawings and claims is incorporated herein by reference in its entirety.

FIELD

The present disclosure relates to a display device.

BACKGROUND

Display devices (hereinafter referred to as organic electroluminescent (EL) display devices) using organic EL elements are being brought into practical use. Generally, an organic EL display device includes (i) a display unit having, arranged in a matrix, pixel circuits each having an organic EL element, and (ii) a drive circuit for driving the display unit.

Conventionally, techniques for reducing luminance unevenness in organic EL display devices are known (for example, Patent Literature (PTL) 1).

PTL 1 discloses a pixel circuit that includes a first pixel switch (write transistor in this application) and a crosstalk cancel switch. The first pixel switch is composed of a transistor and has a gate electrode connected to a second scanning line (write control line in this application), a source electrode connected to a video signal line (data line in this application), and a drain electrode connected to a gate electrode of a drive transistor (drive transistor in this embodiment). The crosstalk cancel switch is composed of a transistor of a conductivity type different from the first pixel switch, and has a gate electrode connected to a second scanning line, and a source electrode and a gate electrode which are both connected to the video signal line.

In PTL 1, the crosstalk cancel switch makes it possible to reduce the capacitance change occurring in the second scanning line as a result of the parasitic capacitance difference generated in the first pixel switch being different according to the grayscale potential applied to the video signal line. Accordingly, the effect on the potential of the gate electrodes of the drive transistors of the plurality of pixel circuits connected to the second scanning line is reduced, which reduces the occurrence of lateral crosstalk.

CITATION LIST

Patent Literature

[PTL 1] Japanese Unexamined Patent Application Publication No. 2011-215401

SUMMARY

Technical Problem

In the display device in PTL 1, however, a crosstalk cancel switch is provided in each of the pixel circuits, and thus the pixel circuit area tends to become large, which is disadvantageous in terms of enhancing definition in display devices.

In view of this, the present disclosure provides a display device capable of reducing luminance unevenness using a configuration suitable for enhancing definition.

Solution to Problem

In order to achieve the aforementioned object, a display device according to an aspect of the present disclosure includes: a plurality of pixel circuits connected to a write control line; a compensation circuit connected to the write control line; and a compensation voltage generation circuit that outputs, to a compensation signal line, a compensation control voltage which is variable, wherein each of the plurality of pixel circuits includes: a drive transistor; a capacitor connected to a gate electrode and a source electrode of the drive transistor; a light-emitting element which is driven by the drive transistor; and a write transistor having a gate electrode, a drain electrode, and a source electrode, the gate electrode being connected to the write control line, one of the drain electrode and the source electrode being connected to a data line for transmitting a data voltage corresponding to luminance of the pixel circuit, the other of the drain electrode and the source electrode being connected to the gate electrode of the drive transistor, the compensation circuit includes a voltage-dependent capacitor connected to the compensation signal line and the write control line, the compensation voltage generation circuit outputs the compensation control voltage in accordance with a representative value of the data voltage for the plurality of pixel circuits, and a capacitance component of the write control line caused by parasitic capacitance of the write transistors of the plurality of pixel circuits and a capacitance component of the write control line caused by the voltage-dependent capacitor have mutually opposite voltage dependence with respect to the representative value of the data voltage for the plurality of pixel circuits.

Advantageous Effects

According to the disclosed display device, since the voltage dependence of the capacitance of the write control line with respect to the representative value of the data voltage in the plurality of pixel circuits decreases, the difference in the capacitance of the write control line caused by the difference in the data voltage transmitted by the data line becomes smaller. Accordingly, since the difference in the waveform of the write signals when the overall luminance of the plurality of pixel circuits is high and when it is low decreases, unevenness that is dependent on the luminance in an ON period in which the write transistor is in a conducting state decreases. By performing mobility correction in the ON period, the unevenness in the luminance dependence of mobility correction amount is reduced, and display device luminance unevenness caused by mobility correction amount inconsistency decreases. The compensation circuit can be provided in a region different from the pixel circuits, and thus does not increase pixel circuit area, and does not hinder enhancement of definition in the display device.

BRIEF DESCRIPTION OF DRAWINGS

These and other objects, advantages and features of the disclosure will become apparent from the following description thereof taken in conjunction with the accompanying drawings that illustrate a specific embodiment of the present disclosure.

DESCRIPTION OF EMBODIMENT (Underlying Knowledge Forming the Basis of the Present Disclosure)

Before carrying out a detailed description of a display device according to an embodiment of the disclosure, the configuration of a typical display device assumed in the present disclosure and the luminance unevenness (particularly crosstalk) occurring in the display device will be described.

(Configuration of Typical Display Device)

Figure 1:
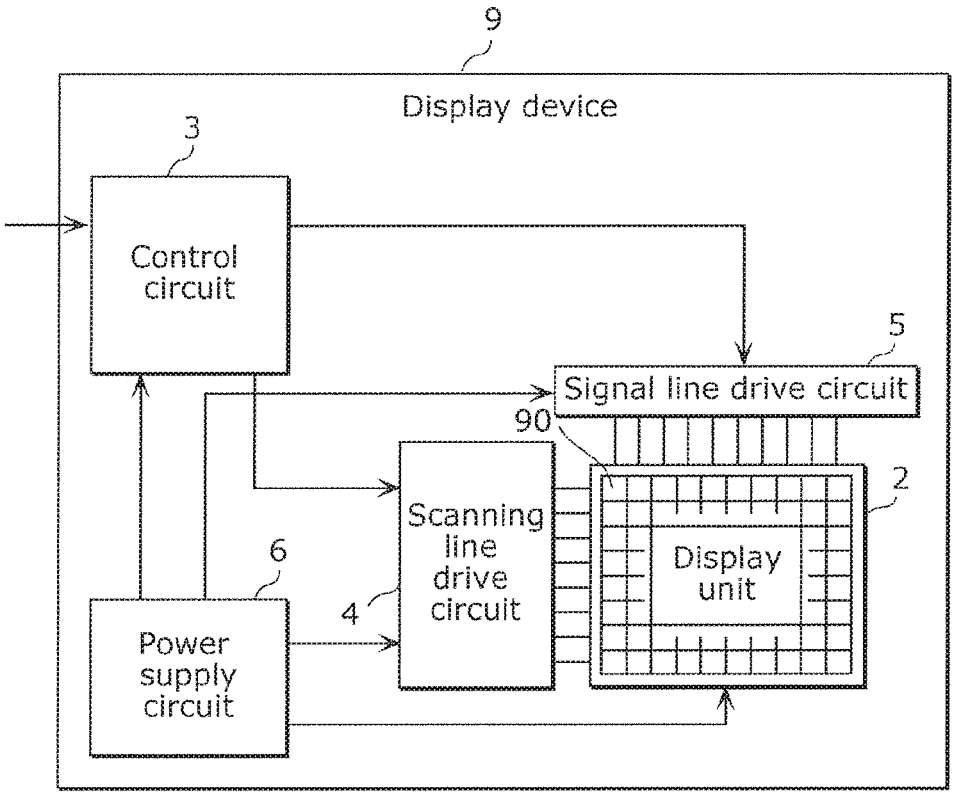
FIG. 1 is a function block diagram illustrating an example of a configuration of a typical display device.

FIG. 1 is a function block diagram illustrating an example of a configuration of a typical display device 9.

The display device 9 includes a display unit 2, a control circuit 3, a scanning line drive circuit 4, a signal line drive circuit 5, and a power supply circuit 6.

The display unit 2 includes a plurality of pixel circuits 90 which are arranged in a matrix. Each of rows in the matrix is provided with a scanning line connected in common to the pixel circuits 90 that are arranged in the same row, and each of the columns of the matrix is provided with a data signal line connected in common to the pixel circuits 90 that are arranged in the same column.

The control circuit 3 is a circuit that controls the operation of the display device 9, receives a video signal from an external source, and controls the scanning line drive circuit 4 and the signal line drive circuit 5 so that the image represented by the video signal is displayed by the display unit 2.

The scanning line drive circuit 4 supplies a control signal for controlling the operation of the pixel circuit 90, to the pixel circuit 90 via the scanning line.

The signal line drive circuit 5 supplies a data signal corresponding to the luminance, to the pixel circuit 90 via the data signal line.

The power supply circuit 6 supplies power for the operation of the display device 9, to the respective parts of the display device 9.

Figure 2:
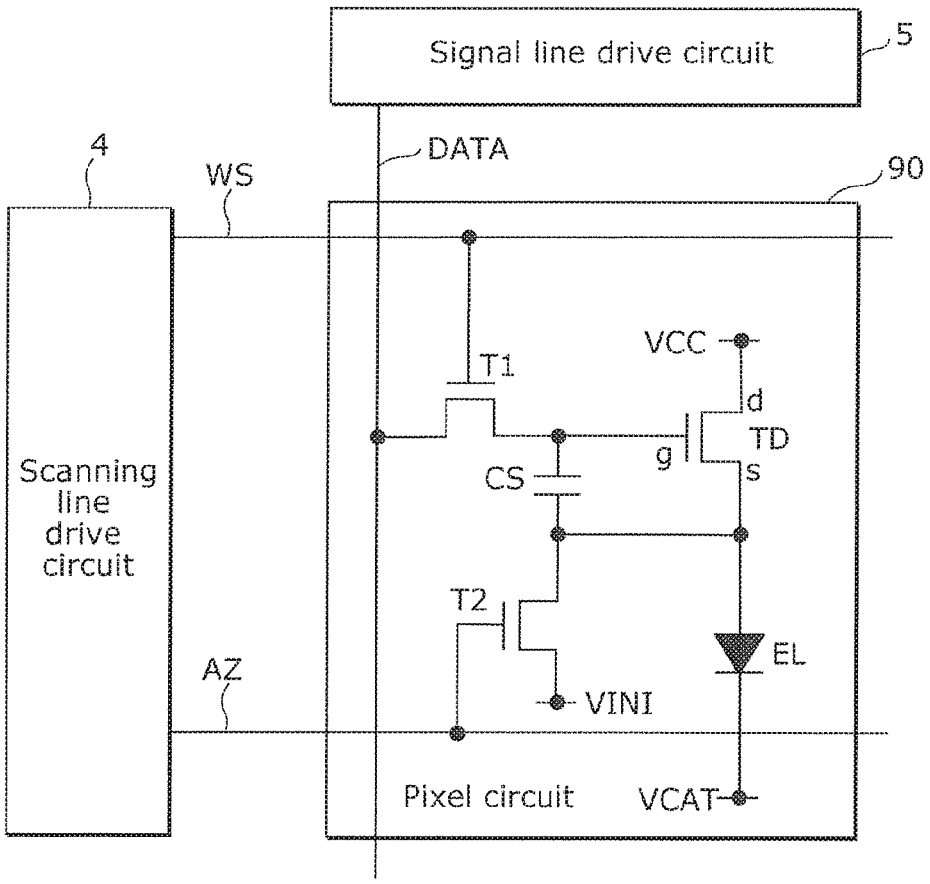
FIG. 2 is a circuit diagram illustrating an example of a configuration of a typical pixel circuit.

FIG. 2 is a circuit diagram illustrating an example of the configuration of a pixel circuit 90. FIG. 2 illustrates, in addition to the internal configuration of the pixel circuit 90, an example of the connection between the pixel circuit 90 and the scanning line drive circuit 4 and signal line drive circuit 5.

A signal line WS and a signal line AZ are provided, as scanning signal lines, in each of the rows of the display unit 2, and a signal line DATA is provided, as a data signal line, in each of the columns of the display unit 2. Here, the signal line WS and the signal line AZ are examples of a write control line and an initialization control line, respectively. The signal line DATA is an example of a data line.

Furthermore, display unit 2 is provided with a power supply line VCC and a power supply line VCAT for transmitting and distributing, to the pixel circuit 90, power supply voltage supplied from the power supply circuit 6; and an initialization voltage line VINI for transmitting and distributing, to the pixel circuit 90, a fixed initialization voltage supplied from power supply circuit 6. The power supply lines VCC and VCAT, and the initialization voltage line VINI are connected in common to all of the pixel circuits 90.

Each of the pixel circuits 90 arranged in the display unit 2 is connected to the scanning line drive circuit 4 by the signal lines WS and AZ of the row in which the pixel 90 is located, and is connected to the signal line drive circuit 5 by the signal line DATA of the row in which the pixel 90 is located.

The signal line WS transmit and the signal line AZ transmit a write signal and an initialization signal, respectively, for controlling the operation of the pixel circuit 90, from the scanning line drive circuit 4 to the pixel circuit 90. The signal line DATA transmits a data signal corresponding to luminance, from the signal line drive circuit 5 to the pixel circuit 90.

The pixel circuit 90 is a circuit that causes an organic EL element to emit light at a luminance corresponding to the data signal, and includes a drive transistor TD, a write transistor T1, an initialization transistor T2, a capacitor CS, and a light-emitting element EL. The light-emitting element EL is composed of an organic EL element.

The drive transistor TD has a drain electrode d connected to the power supply line VCC.

Capacitor CS has a first electrode (upper electrode in the figure) connected to a gate electrode g of the drive transistor TD, and a second electrode (lower electrode in the figure) connected to a source electrode s of the drive transistor TD.

The write transistor T1 switches between conduction and non-conduction between the gate electrode g of drive transistor TD and the signal line DATA, according to the write signal transmitted by the signal line WS.

The initialization transistor T2 switches between conduction and non-conduction between the source electrode s of drive transistor TD and the initialization voltage line VINI, according to the initialization signal transmitted by the signal line AZ.

The light-emitting element EL has a first electrode (upper electrode in the figure) connected to the source electrode s of the drive transistor TD, and a second electrode (lower electrode in the figure) connected to the power supply line VCAT, and is driven by the output current (drain-source current) of the drive transistor TD.

(Operation of a Typical Display Device)

Figure 3:
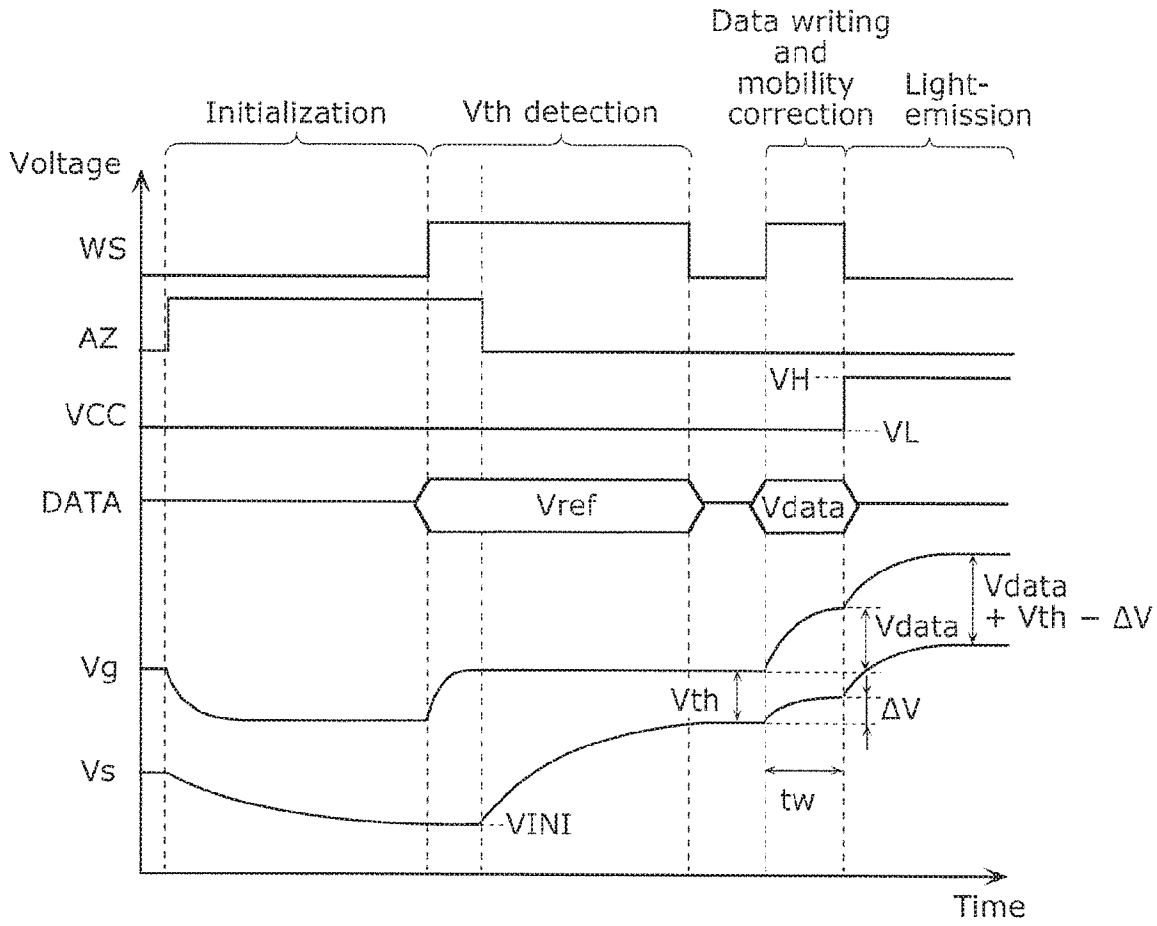
FIG. 3 is a signal waveform chart illustrating an example of operation of a typical pixel circuit.

FIG. 3 is a waveform chart illustrating an example of control signals, power supply voltages, and data signals for operating the pixel circuit 90. In FIG. 3, the vertical axis denotes the level of each signal, and the horizontal axis represents the passing of time. Furthermore, for the sake of brevity and clarity, the control signals, the data voltages, and the power supply voltages are given the same reference signs as the signal lines and power supply lines through which they are transmitted. Voltage Vg represents the voltage of the gate electrode g of the drive transistor TD, and voltage Vs represents the voltage of the source electrode s of the drive transistor TD.

In the example in FIG. 3, the write transistor T1 is placed in the conducting state and the non-conducting state in the periods in which the write signal WS is at a high level and a low level, respectively. Furthermore, the initialization transistor T2 is placed in the conducting state and the non-conducting state in the periods in which the initialization signal AZ is at a high level and a low level, respectively.

The fundamental operations of the pixel circuit 90 performed according to the control signals and data signals illustrated in FIG. 3 will be described.

In the initialization period, an initialization operation is performed.

Initialization signal AZ is set to the high level, and initialization voltage VINI is applied to the source electrode s of the drive transistor TD via the initialization transistor T2. Accordingly, source voltage Vs of drive transistor TD is initialized to initialization voltage VINI.

Power supply voltage VCC may be maintained at voltage VL (<VCAT+Vth (EL)) which is lower than a voltage obtained by adding light-emission start voltage Vth (EL) of light-emitting element EL to power supply voltage VCAT, from the initialization period and over the subsequent Vth detection period and data writing and mobility correction period. Accordingly, the light-emission of the light-emitting element EL can be inhibited, and thus display contrast deterioration and power consumption increase due to unnecessary light-emission by the light-emission element EL can be suppressed.

Next, in the Vth detection period, a Vth detection operation is performed.

Figure 4:
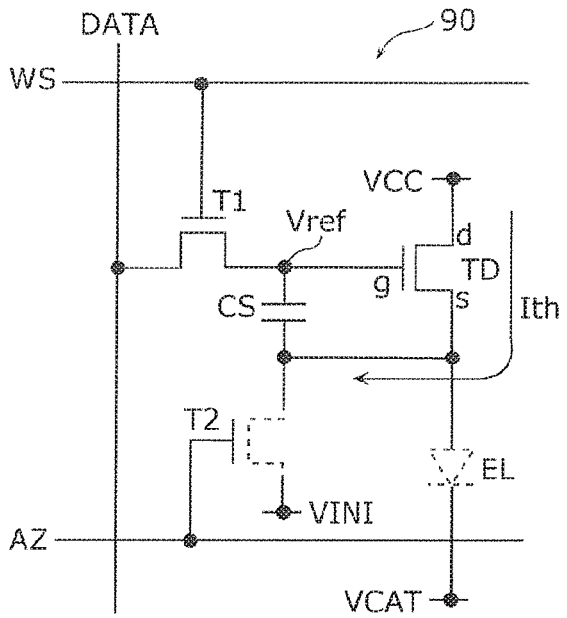
FIG. 4 is a circuit diagram illustrating an example of operation of a typical pixel circuit.

FIG. 4 is a circuit diagram for describing the operation of the pixel circuit 90 in the Vth detection period.

Data voltage DATA is set to reference voltage Vref and write signal WS is set to the high level, and thus reference voltage Vref is applied to the gate electrode g of the drive transistor TD via the write transistor T1. Furthermore, initialization signal AZ is set to the low level, and the application of initialization voltage VINI to the source electrode s of the drive transistor TD stops.

For the reference voltage Vref, a voltage Vref (>VINI+Vth) which is higher than a voltage obtained by adding, to initialization voltage VINI, the largest value of threshold voltage Vth of the drive transistors TD of all of the pixel circuits 90 of display unit 2. Accordingly, the drive transistor TD is placed in the conducting state, and drain-source current Ith flows.

Drain-source current Ith charges the capacitor CS, and the voltage of the second electrode of the capacitor CS, that is, source voltage Vs of the drive transistor TD rises from initialization voltage VINI. In addition, when source voltage Vs of the drive transistor TD rises up to voltage Vref−Vth, the drive transistor TD is placed in the non-conducting state and drain-source current Ith stops.

In this manner, source voltage Vs of the drive transistor TD converges to voltage Vref−Vth obtained by subtracting threshold voltage Vth from reference voltage Vref.

Next, in the data writing and mobility correction period, a data writing and mobility correction operation is performed.

Figure 5:
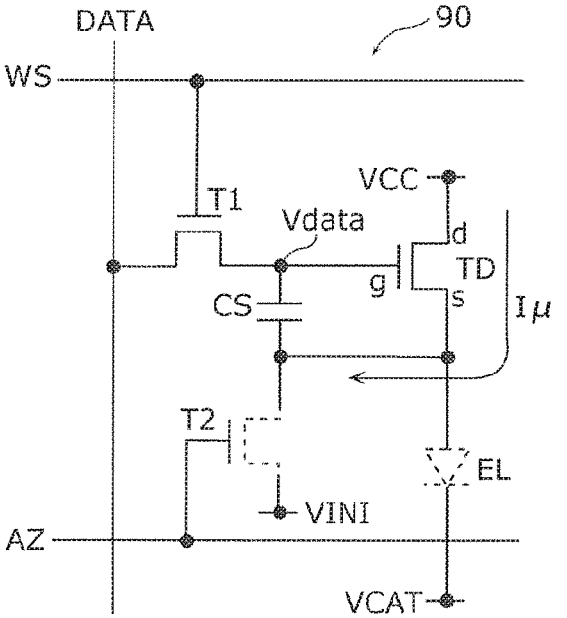
FIG. 5 is a circuit diagram illustrating an example of a configuration of a typical pixel circuit.

FIG. 5 is a circuit diagram for describing the operation of the pixel circuit 90 in the data writing and mobility correction period.

Data voltage DATA is set to voltage Vdata corresponding to the luminance at which the pixel circuit 90 is to be caused to emit light and write signal WS is set to the high level, and thus voltage Vdata is applied to the gate electrode g of the drive transistor TD.

At this time, since the gate-source voltage of the drive transistor TD is set to threshold voltage Vth in the preceding Vth detection period, drain-source current Iμ immediately starts to flow in the drain transistor TD. The capacitor CS is charged by current Iμ, and source voltage Vs of the drive transistor TD starts to rise toward voltage Vdata−Vth.

In the data writing and mobility correction period, gate voltage Vg of the drive transistor TD is set to voltage Vdata, and source voltage Vs rises by a voltage ΔV in accordance with current Iμ. Accordingly, the gate-source voltage of the drive transistor TD is set to voltage Vdata+Vth−ΔV.

The bigger parameter β of drive transistor TD is, the bigger current Iμ becomes. Here, parameter β is represented as $\beta=\mu\times Cox\times W/L$, where μ denotes mobility, Cox denotes gate insulating film capacitance per unit area, W denotes channel width, and L denotes channel length. By managing conducting time tw of the write transistor T1 to a constant length, parameter β of drive transistor TD is reflected on voltage ΔV at a constant rate.

Subsequently, in the light emission period, a light-emitting operation is performed.

Power supply voltage VCC is set to voltage VH for causing drive transistor TD to operate in a saturation region. The drive transistor TD operating in the saturation region functions as a constant current source that passes drain-source current Ids represented by β (Vgs−Vth) 2. Here, β denotes the above-described parameter, Vgs denotes the gate-source voltage, and Vth denotes the threshold voltage.

Gate-source voltage Vgs of the drive transistor TD is set to voltage Vdata+Vth−ΔV in the preceding data writing and mobility correction period. As such, in the light-emission period, the drive transistor TD supplies drain-source current Ids represented by β (Vdata−ΔV) 2, to the light-emitting element EL.

Drain-source current Ids has no dependence on threshold voltage Vth, and since the term of (Vdata−ΔV) decreases as parameter β increases, dependence on parameter β is small.

The light-emitting element EL, by being driven according to drain-source current Ids, emits light at a luminance obtained after correcting the error caused by threshold voltage Vth and parameter β (including mobility μ). In other words, the light-emitting element EL emits light at a luminance after Vth correction and mobility correction have been performed and which precisely corresponds to voltage Vdata.

According to display device 9, each of the pixel circuits 90 emit light at a precise luminance in accordance to the above-described operations, and thus reduction in luminance unevenness is expected.

(Luminance Unevenness in a Typical Display Device)

However, according to the configuration and operation of the pixel circuit 90, in actuality, there are instances where luminance unevenness occurs due to the parasitic capacitance of the write transistor T1. Hereinafter, this luminance unevenness will be described.

Figure 6:
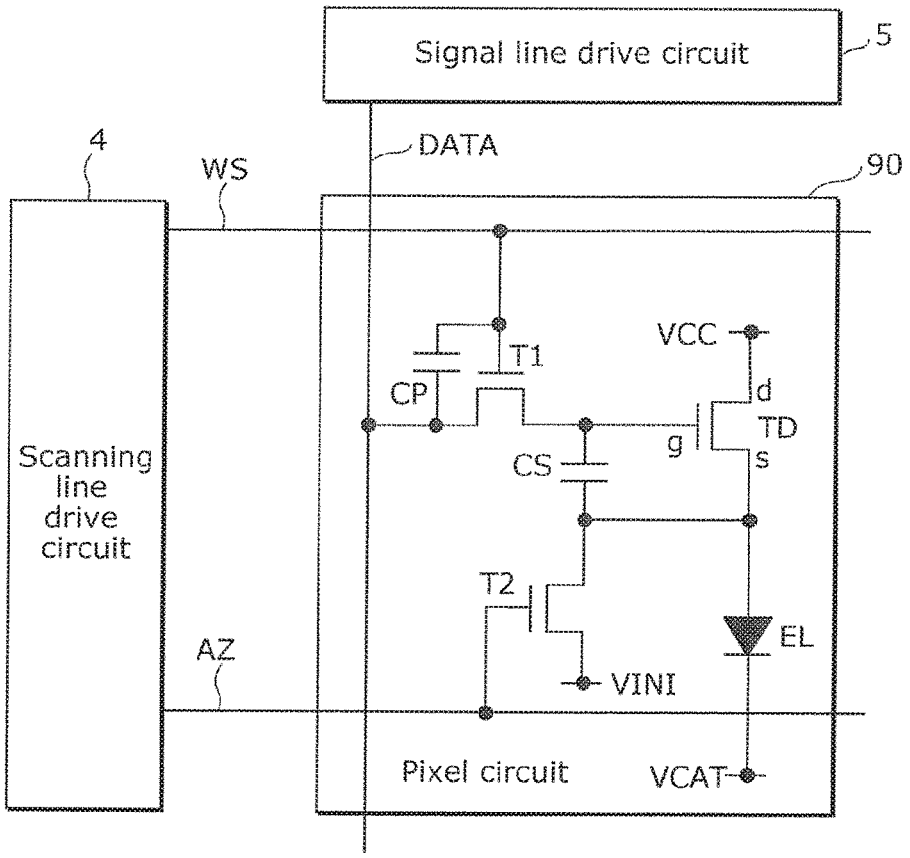
FIG. 6 is a circuit diagram illustrating a practical example of a configuration of a typical pixel circuit.

FIG. 6 is a circuit diagram illustrating an example of an actual configuration of the pixel circuit 90. In FIG. 6, the parasitic capacitance CP of an actual write transistor T1 is clearly illustrated. The parasitic capacitance of the write transistor T1 is an MIS (metal-insulator-semiconductor) capacitance generated in an MIS structure including a gate electrode, a gate insulating film, and a channel semiconductor layer, and is voltage dependent.

Figure 7:
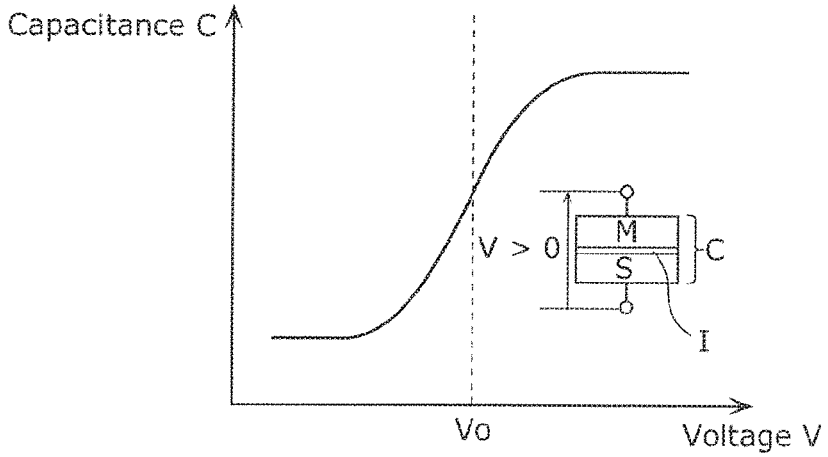
FIG. 7 is a graph illustrating an example of the voltage dependence of the MIS capacitance.

FIG. 7 is a graph illustrating an example of the voltage dependence of the MIS capacitance. In FIG. 7, the capacitor "C" is shown as including a stacked body comprised of a metal layer "M", an insulating layer "I", and a semiconductor layer "S". As illustrated in FIG. 7, when positive voltage V is applied to a metal layer with the semiconductor layer as a reference, the MIS structure has MIS capacitance C which is dependent on the applied voltage. MIS capacitance C rapidly increases when the applied voltage V exceeds threshold voltage Vo.

Figure 8:
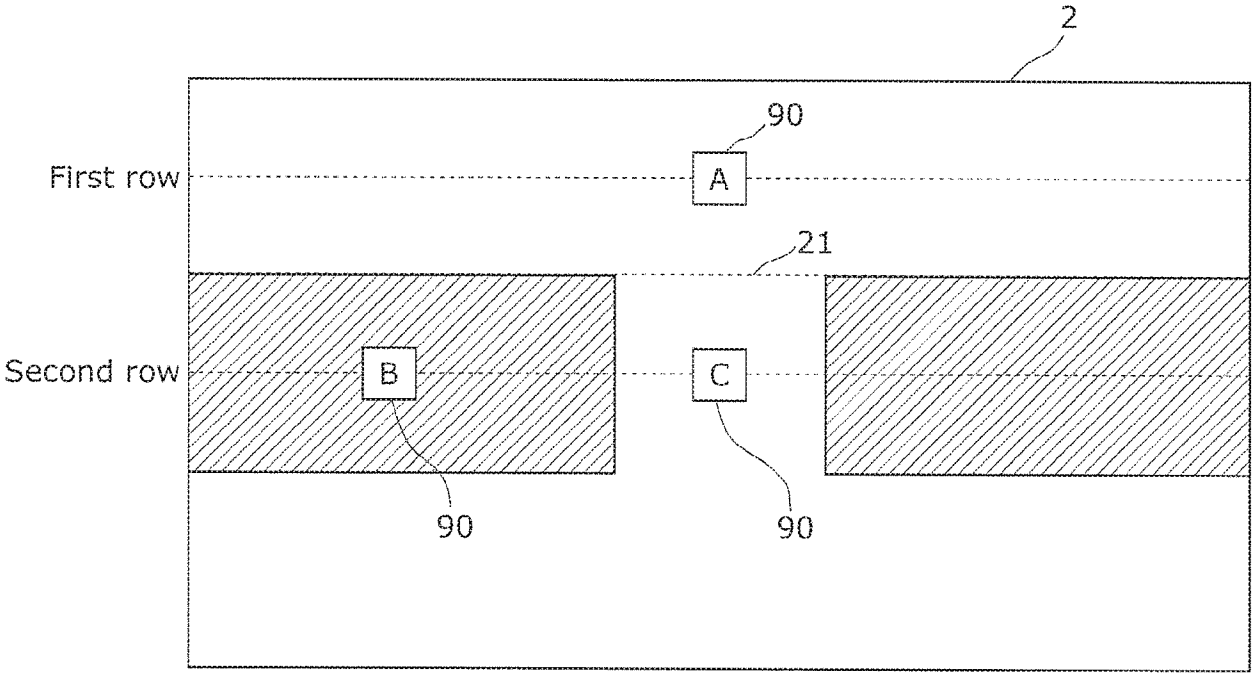
FIG. 8 is a diagram illustrating an example of an image in which luminance unevenness tends to occur.

FIG. 8 is a diagram illustrating an example of an image in which luminance unevenness (particularly crosstalk) tends to occur. When displaying the image, among the pixel circuits 90 included in the display unit 2: in a first row, all pixel circuits A emit light at a first luminance; in a second row, pixel circuits B, which are the majority, emit light at a second luminance lower than a first luminance and pixel circuits C, which are the minority, emit light at the first luminance. In the subsequent description, for the sake of brevity and clarity, the first luminance and the second luminance are referred to as high luminance and low luminance, respectively.

Figure 9:
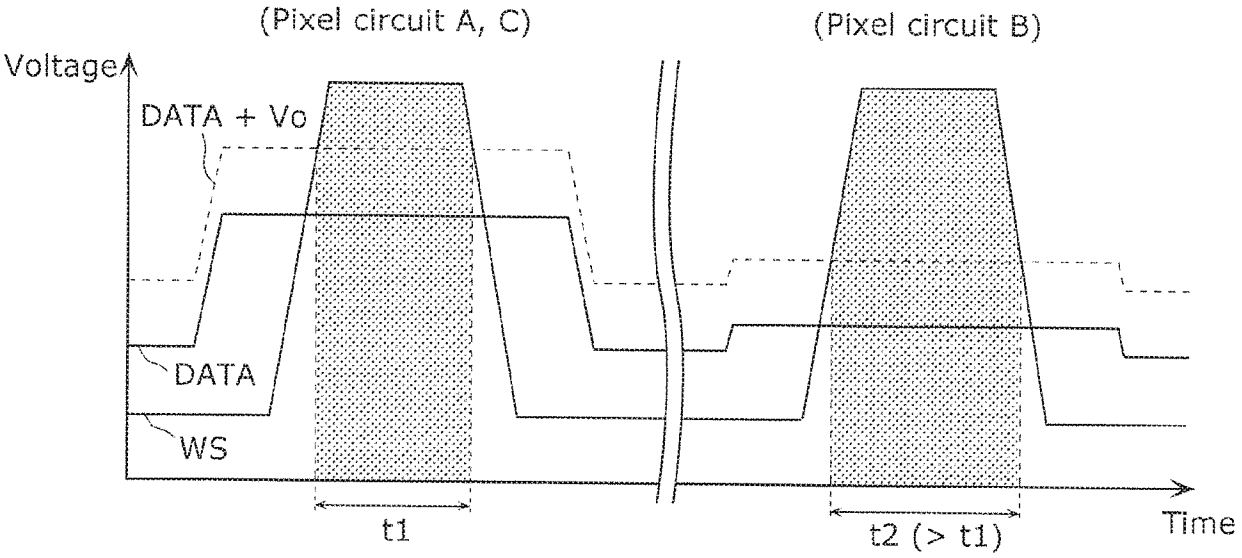
FIG. 9 is a signal waveform chart illustrating an example of operation of a typical pixel circuit.

FIG. 9 is a waveform chart illustrating an example of control signals and data signals involved in the operations of each of the pixel circuits A and C which emit light at the high luminance and the pixel circuits B which emit light at the low luminance, in the data writing and mobility correction period when displaying of the image illustrated in FIG. 8.

In FIG. 9, the amplitude of write signal WS is constant, and, in accordance with the luminance for the pixel circuits, data voltage DATA is high for the pixel circuits A and C, and low for the pixel circuits B. In order to understand the change in the parasitic capacitance of the write transistor T1, voltage DATA+Vo obtained by adding voltage Vo to data voltage DATA is shown. Based on the description for FIG. 7, in the periods (indicated by shading) where WS>DATA+Vo is satisfied, the write transistor T1 has a large parasitic capacitance compared to other periods.

As such, period t2 in which the write transistor T1 has a large parasitic capacitance in the pixel circuits B for which data voltage DATA is low is longer than period t1 in which the write transistor T1 has a large parasitic capacitance in the pixel circuits A and C for which data voltage DATA is high (t2>t1). In other words, in the entirety of the data writing and mobility correction period, the write transistor T1 has a larger parasitic capacitance in pixel circuits B compared to pixel circuits A and C.

As illustrated in FIG. 1, in each row, a predetermined number of the pixel circuits 90 are connected to the signal line WS of the row, and are controlled by write signal WS transmitted by the signal line WS. As such, the capacitance of signal line WS as seen from the scanning line drive circuit 4 is a capacitance obtained by multiplying the capacitance per pixel circuit 90 by the number of pixel circuits 90 disposed in one row, and thus an extremely big change may occur in the capacitance of signal line WS.

Specifically, the capacitance of signal line WS changes the most between the case where the average luminance of the pixel circuits 90 connected to the signal line WS is at maximum and the case where the average luminance is at minimum (for example, between the case where all the pixel circuits emit light at maximum luminance and the case where all the pixel circuits emit light at minimum luminance). As such, in accordance with the average luminance of the pixel circuits 90 connected to the signal line WS, a large difference is created in the waveform of write signal WS.

Figure 10:
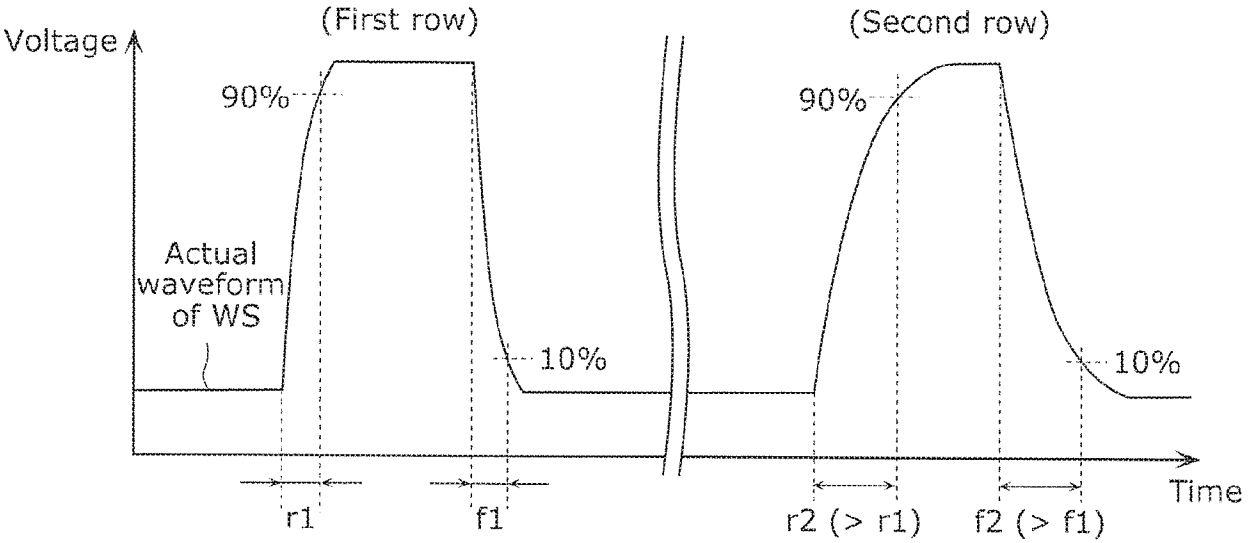
FIG. 10 is a waveform chart schematically illustrating an example of an actual waveform of a write signal.

FIG. 10 is a waveform chart schematically illustrating an example of an actual waveform of the write signal WS. Whereas the waveform rounding of write signal WS becomes smallest in the first row in which the average luminance of the pixel circuits 90 is at maximum, the waveform rounding of write signal WS is large in the second row in which the average luminance of the pixel circuits 90 is at maximum.

Specifically, waveform rounding may be quantified by the rise time and the fall time of the waveform. The rise time may be represented by the time it takes from when the signal starts to rise until 90% amplitude is reached (for example, r1 and r2 in FIG. 10), and the fall time is represented by the time it takes from when the signal starts to fall until 10% amplitude is reached (for example, f1 and f2 in FIG. 10).

The rise time is an index, the larger the value of which represents a larger amount of rounding, and, in the example in FIG. 10, r2>r1. Furthermore, the fall time is an index, the larger the value of which represents a larger amount of rounding, and, in the example in FIG. 10, f2>f1.

Although the luminance of both the pixel circuits A of row 1 and the pixel circuits C of row 2 is the same first luminance (high luminance), the pixel circuits A are controlled by write signal WS which has a small amount of waveform rounding, and the pixel circuits C are controlled by write signal WS which has a large amount of waveform rounding. As a result, between the pixel circuits A and the pixel circuits C, a difference arises in the conducting time tw of the write transistor T1 and a difference arises in the correction amount regarding mobility $\mu$(in a broader sense, parameter $\beta$), in the data writing and mobility correction period.

As such, without a countermeasure for reducing the unevenness in the average luminance dependence of the correction amount, there would arise, between the first row and the second row, a difference in the luminance that is actually produced by the pixel circuits A and C. Specifically, for example, it is possible to have image deterioration such as seeing border line 21 caused by the luminance difference between the first row and the second row. Such a luminance precision deterioration is luminance unevenness, that is, crosstalk, which occurs when the luminance of a pixel circuit is affected by the luminance of other pixel circuits.

As described earlier, although PTL 1 referred to in the Background Art section discloses a technique that reduces such crosstalk, a crosstalk cancel switch is provided in each of the pixel circuits, and thus the pixel circuit area tends to become large, which is disadvantageous in terms of enhancing definition in display devices. In view of this, the configuration of the display device to be described below is arrived at.

(Aspects of the Display Device to be Disclosed)

A display device according to an aspect of the present disclosure includes: a plurality of pixel circuits connected to a write control line; a compensation circuit connected to the write control line; and a compensation voltage generation circuit that outputs, to a compensation signal line, a compensation control voltage which is variable. Each of the plurality of pixel circuits includes: a drive transistor; a capacitor connected to a gate electrode and a source electrode of the drive transistor; a light-emitting element which is driven by the drive transistor; and a write transistor having a gate electrode, a drain electrode, and a source electrode, the gate electrode being connected to the write control line, one of the drain electrode and the source electrode being connected to a data line for transmitting a data voltage corresponding to luminance of the pixel circuit, the other of the drain electrode and the source electrode being connected to the gate electrode of the drive transistor. The compensation circuit includes a voltage-dependent capacitor connected to the compensation signal line and the write control line, the compensation voltage generation circuit outputs the compensation control voltage in accordance with a representative value of the data voltage for the plurality of pixel circuits, and a capacitance component of the write control line caused by parasitic capacitance of the write transistors of the plurality of pixel circuits and a capacitance component of the write control line caused by the voltage-dependent capacitor have mutually opposite voltage dependence with respect to the representative value of the data voltage for the plurality of pixel circuits.

According to this configuration, since the voltage dependence of the capacitance of the write control line with respect to the representative value of the data voltage in the plurality of pixel circuits decreases, the difference in the capacitance of the write control line caused by the difference in the data voltage transmitted by the data line becomes smaller. Accordingly, since the difference in the waveform of the write signals when the overall luminance of the plurality of pixel circuits is high and when it is low decreases, unevenness that is dependent on the luminance in an ON period in which the write transistor is in a conducting state decreases. By performing mobility correction in the ON period, the unevenness in the luminance dependence of mobility correction amount is reduced, and display device luminance unevenness caused by mobility correction amount inconsistency decreases. The compensation circuit can be provided in a region different from the pixel circuits, and thus does not increase pixel circuit area, and does not hinder enhancement of definition in the display device.

Furthermore, the voltage-dependent capacitor may be a stacked body composed of a metal layer connected to one of the compensation signal line and the write control line, an insulating layer, and a semiconductor layer connected to the other of the compensation signal line and the write control line.

According to this configuration, a variable capacitor can be easily manufactured by using the material and manufacturing process of the write transistor.

Furthermore, the voltage-dependent capacitor may be a compensation transistor which has a gate electrode connected to the compensation signal line and at least one of a drain electrode and a source electrode connected to the write control line, and has a same conductivity type as the write transistor.

According to this configuration, transistors of the same conductivity type are used for the write transistor and the compensation transistor. Accordingly, since the compensation transistor can be manufactured using the material and the manufacturing process of the write transistor, without adding a special material or manufacturing process, there is little concern that the pixel circuit manufacturing process will become complex.

Furthermore, a voltage output by the compensation voltage generation circuit as the compensation control voltage may be lower as the representative value of the data voltage for the plurality of pixel circuits is higher, and is higher as the representative value is lower.

According to this configuration, for example, when transistors of the same conductivity type are used for the write transistor and the compensation transistor, the voltage dependence of the capacitance of the write control line can be effectively canceled out.

Hereinafter, a display device according to an aspect of the present disclosure will be described with reference to the drawings.

It should be noted that each of the exemplary embodiments described below shows a general or specific example. The numerical values, shapes, materials, structural elements, the arrangement and connection of the structural elements, etc. shown in the following exemplary embodiment are mere examples, and therefore do not limit the scope of the present invention. Furthermore, among the structural components in the following embodiments, components not recited in any one of the independent claims which indicate the broadest concepts are described as arbitrary structural components.

Embodiment

Display device 1 according to an embodiment is configured by adding to the display device 9 illustrated in FIG. 1, compensation circuits that reduce the voltage dependence of the capacitance of the signal line WS caused by the parasitic capacitance of the write transistors T1 of the plurality of pixel circuits 90. The compensation circuit may be provided in a region different from the pixel circuit 90. Hereinafter, description of matter which is the same as in display device 9 is omitted as appropriate, and description is centered on matter that is characteristic to the display device 1 according to the embodiment.

Figure 11:
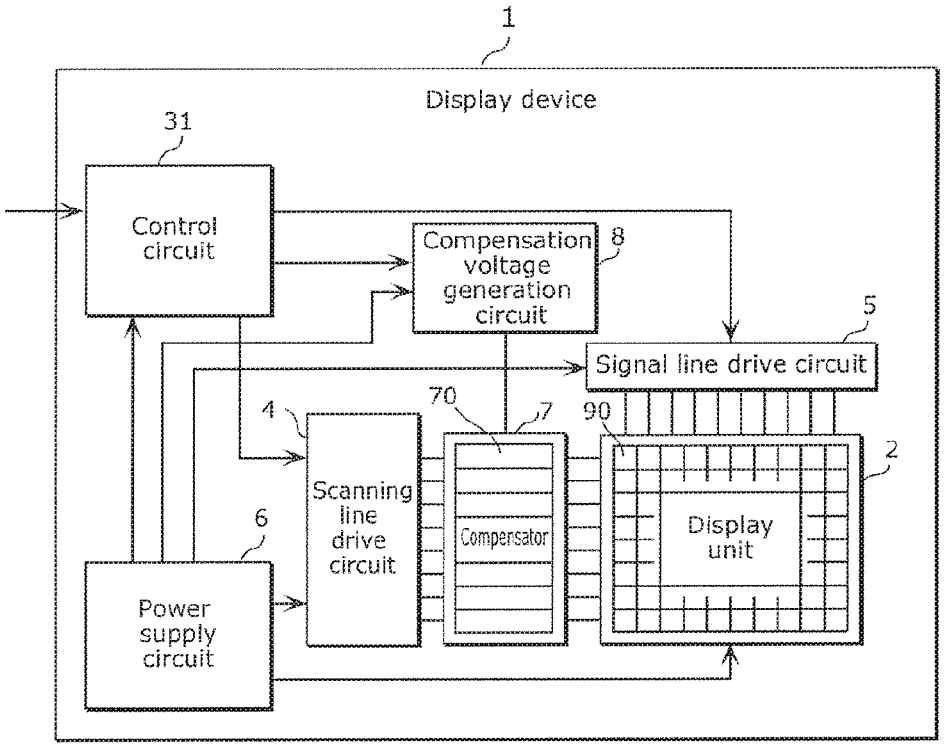
FIG. 11 is a function block diagram illustrating an example of a configuration of a display device according to an embodiment.

FIG. 11 is a circuit diagram illustrating an example of a configuration of the display device 1 according to the embodiment. As illustrated in FIG. 11, compared to the display device 9 illustrated in FIG. 1, the display device 1 is configured by changing the control circuit 3 to control circuit 31 and adding a compensator 7 and a compensation voltage generation circuit 8. The compensator 7 includes a plurality of compensation circuits 70.

The control circuit 31, like the control circuit 3, controls the scanning line drive circuit 4 and the signal line drive circuit 5. The control circuit 31, in addition, instructs the magnitude of a variable compensation control voltage to the compensation voltage generation circuit 8. The compensation voltage generation circuit 8 generates a compensation control voltage of the magnitude instructed by the control circuit 31.

As an example, the control circuit 31 may supply digital data indicating the magnitude of the compensation control voltage to the compensation voltage generation circuit 8, and the compensation voltage generation circuit 8 may convert the digital data into the corresponding voltage by using a digital-to-analog (DA) converter.

Figure 12:
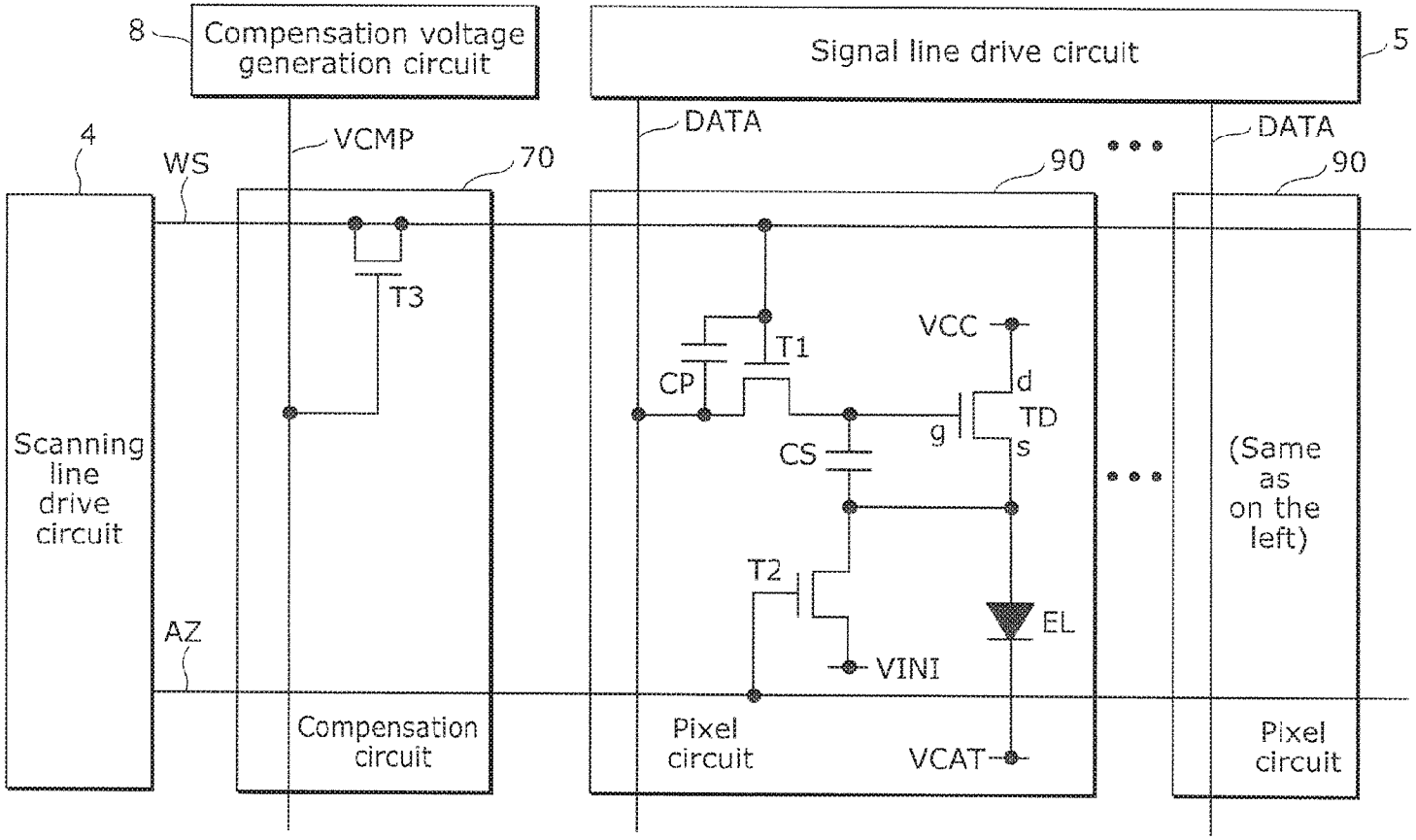
FIG. 12 is a circuit configuration diagram illustrating an example of a configuration of a compensation circuit according to an embodiment.

FIG. 12 is a circuit diagram illustrating an example of the configuration of a compensation circuit 70. FIG. 12 illustrates, in addition to the internal configuration of the compensation circuit 70, the scanning line drive circuit 4, the signal line drive circuit 5, the compensation voltage generation circuit 8, the pixel circuits 90, and an example of the connection between these circuits.

The compensation circuit 70 is connected to a signal line VCMP. The compensation control voltage generated by the compensation voltage generation circuit 8 is supplied to the compensation circuit 70 via the signal line VCMP. The compensation circuit 70 and the pixel circuits 90 are connected to the same signal line WS. The source electrode of the write transistor T1 of each of the pixel circuits 90 is connected to a signal line DATA that is different for each pixel circuit 90.

The configuration composed of signal lines WS and AZ, a compensation circuit 70, and pixel circuits 90 in FIG. 12 is provided, for example, for each of the rows of the display unit 2, and the configuration composed of a pixel circuit 90 and a signal line DATA in FIG. 12 is provided, for example, for each of the columns of the display unit 2.

The compensation circuit 70 is provided in a region different from the pixel circuit 90. The compensation circuit 70 may be provided, for example, as a dummy pixel without a light-emitting function, adjacent to the pixel circuit 90 at the edge.

In the pixel circuit 90, the write transistor T1 is composed of, for example, an n-type metal oxide semiconductor field effect transistor (MOSFET). The write transistor T1 has a gate electrode connected to the signal line WS, one of a drain electrode and a source electrode connected to the signal line DATA, and the other of the drain electrode and the source electrode connected to the gate electrode of the drive transistor TD.

The compensation circuit 70 includes a compensation transistor T3 which serves as a voltage-dependent capacitor connected to the signal line DATA and the signal line WS. The compensation transistor T3 is composed of, for example, an n-type MOSFET which is of the same conductivity type as the write transistor T1. The compensation transistor T3 has a gate electrode connected to the signal line VCMP, and at least one of a drain electrode and a source electrode connected to the signal line WS. Since the compensation transistor T3 is to be used as a voltage-dependent capacitor, it is sufficient that at least one of the drain electrode and the source electrode of the compensation transistor T3 is connected to the signal line DATA.

The signal line WS has a first capacitance component caused by the parasitic capacitance CP of the first write transistor T1 of the pixel circuits 90, and has a second capacitance component caused by the parasitic component of the compensation transistor T3. The capacitance of the signal line WS when seen from the scanning line drive circuit 4 is represented by the total of the first capacitance component and the second capacitance component.

The first capacitance component is the total of the parasitic capacitance CP of the write transistors T1 for the pixel circuits 90. As described above, the first capacitance component is dependent on the average luminance of the pixel circuits 90 connected to the signal line WS. Specifically, the first capacitance component is dependent on a representative value reflecting the average luminance of the data voltages of the pixel circuits 90. The representative value can be represented simply by the average of the data voltages but, aside from the average, may also be represented, for example, by a median or a mode, and may be represented by a weighted average obtained by multiplication with a coefficient that is in accordance with a voltage-luminance characteristic.

In view of this, the control circuit 31 instructs, to the compensation voltage generation circuit 8, a compensation control voltage that gives to the second capacitance component a dependence that is opposite to the dependence of the first capacitance component with respect to the representative value (for example, the average) of the data values.

Detailed description of the compensation control voltage will be continued by giving a specific example.

Figure 13:
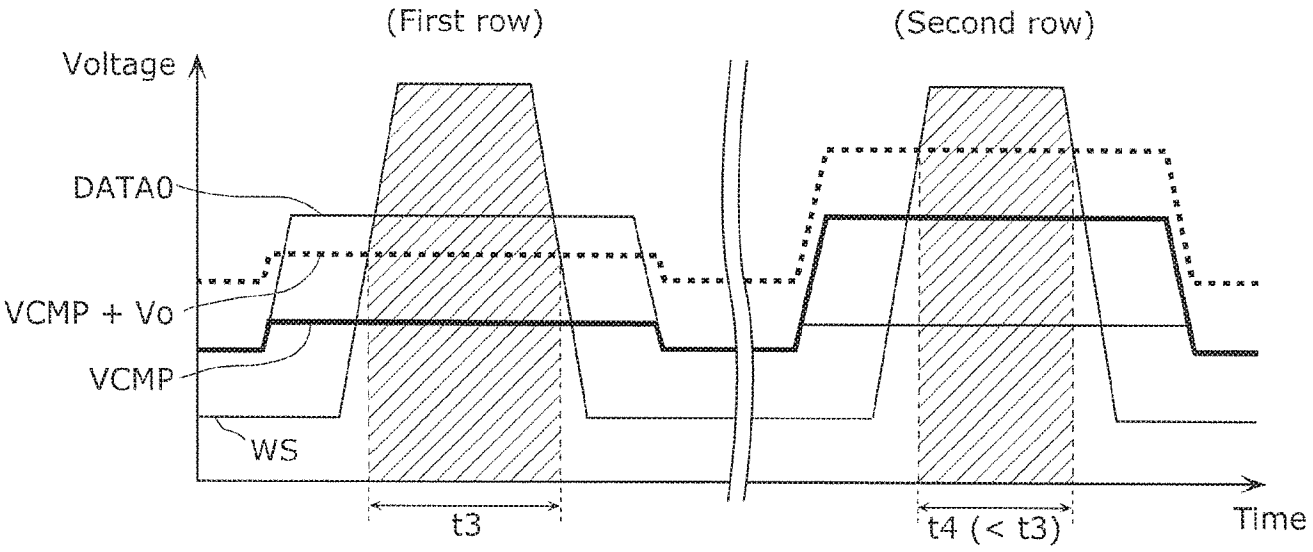
FIG. 13 is a signal waveform chart illustrating an example of operation of the compensation circuit according to the embodiment.

FIG. 13 is a waveform diagram illustrating an example of the compensation control voltage VCMP involved in the operation of the compensation circuit in each of the first row in which the average luminance is high and the second row in which the average luminance is low, in the data writing and mobility correction period during the displaying of an image illustrated in FIG. 8.

In FIG. 13, the amplitude of write signal WS is constant, and, in accordance with the average luminance, the representative value DATA0 of the data voltage (hereafter denoted as representative data voltage DATA0) is high for the first row and low for the second row. The first capacitance component of the signal line WS is the total of the voltage-dependent parasitic capacitance CP of the write transistor T1 described using FIG. 9, and is smaller (first row) as representative voltage DATA0 is higher and is larger as representative data voltage DATA0 is lower.

The control circuit 31 instructs to the compensation voltage generation circuit 8 a compensation control voltage VCMP that is lower as the representative data voltage DATA0 is higher, and is higher as representative data voltage DATA0 is lower. The compensation voltage generation circuit 8 generates the instructed compensation control voltage VCMP, and supplies the compensation control voltage VCMP to the compensation circuit 70.

In FIG. 13, in order to understand the change in the parasitic capacitance of the compensation transistor T3, voltage VCMP+Vo obtained by adding voltage Vo to compensation control voltage VCMP is illustrated. Based on the description in FIG. 7, in the period (indicated by the slanting line) in which WS<VCMP+Vo is satisfied, the compensation transistor T3 has a large parasitic capacitance compared to other periods.

Period t4 in which the compensation transistor T3 has a large parasitic capacitance in the second row in which representative data voltage DATA0 is low is shorter than period t3 in which compensation transistor T3 has a large parasitic capacitance in the first row in which representative data voltage DATA0 is high (t4<t3). As such, in the entirety of the data writing and mobility correction period, the compensation transistor T3 has a larger parasitic capacitance in the first row compared to the second row. Specifically, the second parasitic capacitance of the signal line WS is larger (first row) because compensation control voltage VCMP is lower as representative data voltage DATA0 is higher, and is smaller (second row) because compensation control voltage VCMP is higher as representative data voltage DATA0 is lower.

In this manner, the first capacitance component and the second capacitance component of the signal line WS are have mutually opposite voltage dependence with respect to representative data voltage DATA0.

Since the signal line WS has the first capacitance component and the second capacitance component which have mutually opposite voltage dependencies with respect to representative data voltage DATA0, the unevenness in the luminance dependence of the capacitance of the signal line WS obtained by combining the first capacitance component and the second capacitance component decreases. Therefore, the display device 1 is capable of reducing the unevenness of the luminance dependence of the capacitance of the signal line WS when seen from the scanning line drive circuit 4.

As such, in the display device 1, there is no big difference in the waveform of write signal WS even if the average luminance of the pixel circuits 90 connected to the signal wire WS is different.

Figure 14:
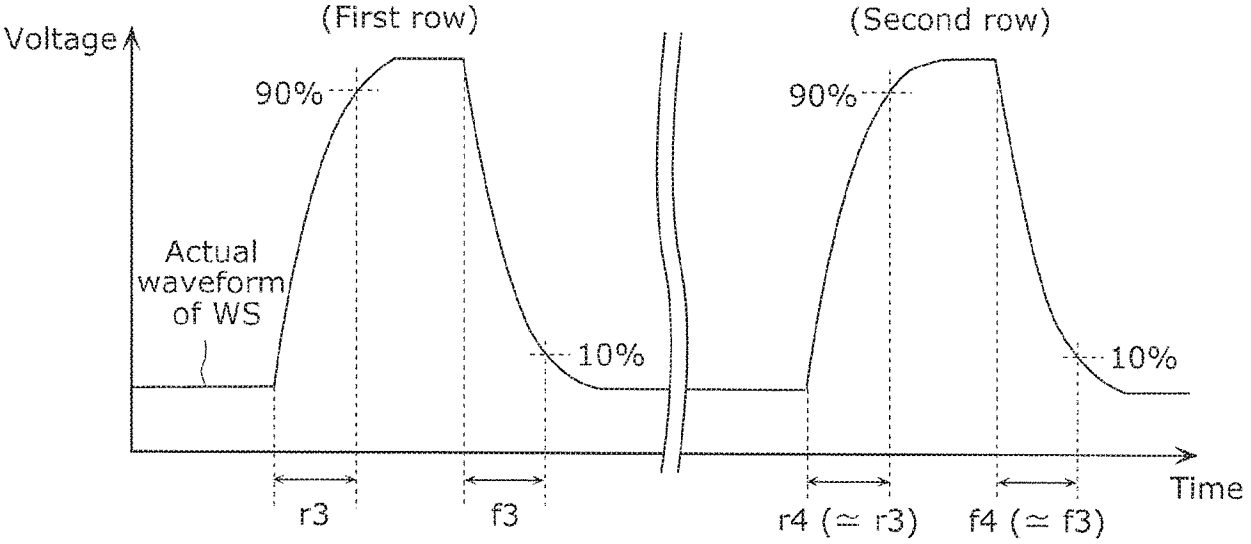
FIG. 14 is a waveform chart schematically illustrating an example of an actual waveform of a write signal according to the embodiment.

FIG. 14 is a waveform chart schematically illustrating an example of a waveform of the write signal WS. Approximately the same amount of waveform rounding occurs in write signal WS for both the first row in which the average luminance of the pixel circuits 90 is high and the second row in which the average luminance of the pixel circuits 90 is low.

In the example in FIG. 14, rise time r3 of row 1 and rise time r4 of row 2 are approximately equal (r4≈r3), and fall time f3 of row 1 and fall time f4 of row 2 are approximately equal (f4≈f3).

It should be noted that the term approximately equal mentioned here means matching within a range of error that is defined as suitable in accordance with the required level for the luminance unevenness in the display device. For example, two time periods included within a ±10% range of the average value may be defined as equal.

In order to obtain a desirable luminance unevenness reducing effect, the rise time of write signal WS transmitted in signal line WS may be approximately equal between when the average luminance of the pixel circuits 90 connected to the signal line WS is at maximum and when it is at minimum. In addition, the fall time of write signal WS transmitted in signal line WS may be approximately equal between when the average luminance of the pixel circuits 90 connected to the signal line WS is at maximum and when it is at minimum.

By satisfying this condition, the waveform rounding of wire signal WS becomes approximately equal in the cases where the capacitance of the signal line WS can change the most, and thus the unevenness in the average luminance dependence of the mobility correction amount is most effectively reduced.

The above described condition is realized by the second capacitance component precisely cancelling out the voltage dependence of the first capacitance component. As such, the compensation transistor T3 may be formed to be bigger than the write transistor T1 so that the parasitic capacitance of the compensation transistor T3 may have a fluctuation range corresponding to the fluctuation range of the parasitic capacitances of the plurality of write transistors 1. The compensation transistor T3 may be formed to a size that substantially occupies the entirety of the compensation circuit 70, and the size of the compensation circuit 70 itself may be made larger than the pixel circuit 90.

As described above, in the display device 1 including the compensation circuit 70, the luminance dependence (data voltage dependence) of the capacitance of the signal line WS is reduced. Accordingly, the unevenness in the luminance dependence of the mobility correction amount is reduced, and it is possible to obtain the display device 1 in which luminance unevenness occurring due to mobility correction amount unevenness is reduced. Furthermore, since the compensation circuit 70 is provided in a different region as the pixel circuit 90, the area of the individual pixel circuits 90 does not increase, and thus enhancement of definition of display device 1 is not hindered.

The display device 1 may be equipped inside a television receiver, for example.

Figure 15:
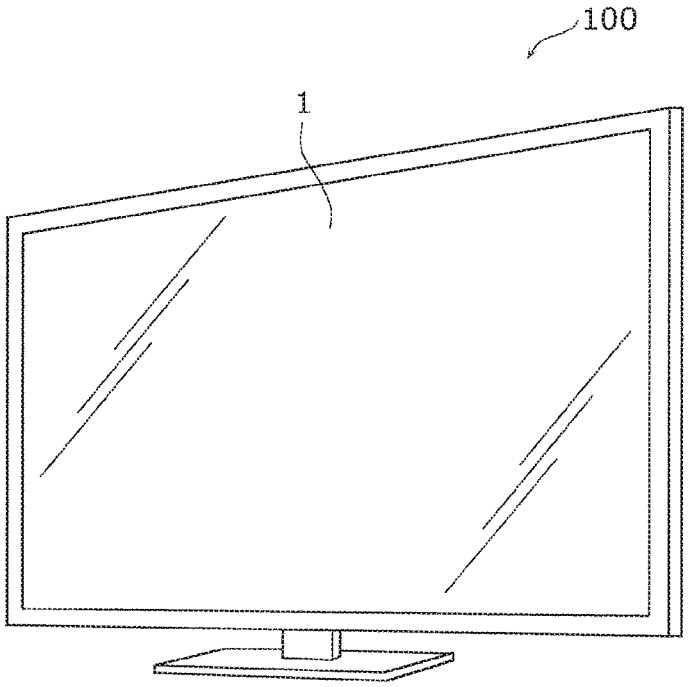
FIG. 15 is an external view illustrating an example of a thin flat-screen TV incorporating the display device according to the embodiment.

FIG. 15 is an external view illustrating an example of a thin flat-screen TV 100 incorporating the display device 1. The thin flat-screen TV 100 capable of precisely displaying video represented by a video signal without luminance unevenness is implemented by having the display device 1 built into the thin flat-screen TV 100.

Although a display device according to some aspects of the present disclosure are described based on an exemplary embodiment thus far, the present disclosure is not limited by this embodiment. Forms obtained by various modifications to the exemplary embodiments that can be conceived by a person of skill in the art as well as forms realized by combining structural components of different exemplary embodiments, which are within the scope of the essence of the present disclosure may be included in the scope of the present disclosure.

For example, although an example in which both the write transistor T1 and the compensation transistor T3 are n-type MOSFETs in the foregoing embodiment, both the write transistor T1 and the compensation transistor T3 may be p-type MOSFETs, or one may be an n-type MOSFET and the other a p-type MOSFET. In any of the modifications, using a compensation control voltage that can be understood by a person of skill in the art based on the description of FIG. 7 makes it possible to obtain advantageous effects that are the same as the advantageous effects described in the foregoing embodiment.

Furthermore, aside from a MOSFET, a two-terminal MIS diode may be used for the voltage-dependent capacitor in the present disclosure. Furthermore, a voltage-controlled variable capacitor having an independently provided control terminal may be used.

INDUSTRIAL APPLICABILITY

The present invention is useful in display device using organic EL elements, and is particularly useful in an active-matrix organic EL display device.

The invention claimed is:

1. A display device, comprising:

a plurality of pixel circuits connected to a write control line;

a compensation circuit connected to the write control line; and a compensation voltage generation circuit that outputs, to a compensation signal line, a compensation control voltage which is variable, wherein each of the plurality of pixel circuits includes:

a drive transistor;

a capacitor connected to a gate electrode and a source electrode of the drive transistor;

a light-emitting element which is driven by the drive transistor; and a write transistor having a gate electrode, a drain electrode, and a source electrode, the gate electrode being connected to the write control line, one of the drain electrode and the source electrode being connected to a data line for transmitting a data voltage corresponding to luminance of the pixel circuit, the other of the drain electrode and the source electrode being connected to the gate electrode of the drive transistor, the compensation circuit includes a voltage-dependent capacitor connected to the compensation signal line and the write control line, the compensation voltage generation circuit outputs the compensation control voltage in accordance with a representative value of the data voltage for the plurality of pixel circuits, and a capacitance component of the write control line caused by parasitic capacitance of the write transistors of the plurality of pixel circuits and a capacitance component of the write control line caused by the voltage-dependent capacitor have mutually opposite voltage dependence with respect to the representative value of the data voltage for the plurality of pixel circuits, wherein the voltage-dependent capacitor is a stacked body composed of a metal layer connected to one of the compensation signal line and the write control line, an insulating layer, and a semiconductor layer connected to the other of the compensation signal line and the write control line, and wherein the capacitance of the voltage-dependent capacitor increases when voltage is applied to the metal layer, the capacitance increasing rapidly near the threshold voltage of the write transistor.

2. The display device according to claim 1, wherein the voltage-dependent capacitor is a compensation transistor which has a gate electrode connected to the compensation signal line and at least one of a drain electrode and a source electrode connected to the write control line, and has a same conductivity type as the write transistor.

3. The display device according to claim 2, wherein a voltage output by the compensation voltage generation circuit as the compensation control voltage is lower as the representative value of the data voltage for the plurality of pixel circuits is higher, and is higher as the representative value is lower.

* * * * *